US009663190B2

(12) United States Patent
Liu

(10) Patent No.: US 9,663,190 B2
(45) Date of Patent: May 30, 2017

(54) TAIL FIN ASSEMBLY FOR INFLATABLE PRODUCT

(71) Applicant: Bestway Inflatables & Material Corp., Shanghai (CN)

(72) Inventor: Feng Liu, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 0 days.

(21) Appl. No.: 14/848,142

(22) Filed: Sep. 8, 2015

(65) Prior Publication Data

US 2016/0355236 A1 Dec. 8, 2016

(30) Foreign Application Priority Data

Jun. 2, 2015 (CN) ..... 2015 2 0372095 U

(51) Int. Cl.

*B63B 35/71* (2006.01)
*B63B 7/08* (2006.01)
*B63B 35/79* (2006.01)

(52) U.S. Cl.

CPC ..... *B63B 7/085* (2013.01); *B63B 35/71* (2013.01); *B63B 35/793* (2013.01); *B63B 35/7913* (2013.01); *B63B 2035/715* (2013.01)

(58) Field of Classification Search

CPC ..... B63B 35/7913; B63B 35/793
See application file for complete search history.

(56) References Cited

U.S. PATENT DOCUMENTS

| | | | | |
|---|---|---|---|---|
| 3,585,663 | A | 6/1971 | Johnson | |
| 4,044,416 | A | 8/1977 | Brewer et al. | |
| 4,421,492 | A | 12/1983 | Leva | |
| 4,789,368 | A | 12/1988 | D'Onofrio | |
| 5,672,081 | A | 9/1997 | Whitty | |
| 5,975,974 | A | 11/1999 | McCausland | |
| 6,139,383 | A | 10/2000 | Jolly et al. | |
| 6,164,237 | A * | 12/2000 | Coryell | B63H 16/06 114/345 |
| 6,991,504 | B1 | 1/2006 | English et al. | |
| 8,246,406 | B2 | 8/2012 | Field | |
| 8,465,334 | B2 | 6/2013 | Hort et al. | |
| 2010/0178820 | A1 | 7/2010 | Kumano et al. | |
| 2012/0131770 | A1 * | 5/2012 | Iwahara | F16B 21/086 24/458 |
| 2014/0245943 | A1 * | 9/2014 | Swan | B63B 7/087 114/345 |

FOREIGN PATENT DOCUMENTS

WO 00/09222 A2 2/2000

* cited by examiner

*Primary Examiner* — Edwin Swinehart
(74) *Attorney, Agent, or Firm* — Squire Patton Boggs (US) LLP

(57) ABSTRACT

A tail fin assembly for an inflatable product is provided. The tail fin assembly includes a pedestal coupled to a surface of the inflatable product, and a sliding groove positioned on the pedestal, where the sliding groove includes a pair of protruding locking members formed in one end of the sliding groove. The tail fin also includes a fin having a fin body and a fin base, where the fin body is detachably coupled to the pedestal at the fin base which slidably engages the sliding groove. A retainer is coupled to the fin body near the fin base for locking with the protruding locking members to secure the fin to the pedestal.

13 Claims, 4 Drawing Sheets

TAIL FIN ASSEMBLY FOR INFLATABLE PRODUCT

CROSS-REFERENCE TO RELATED APPLICATIONS

This application claims priority to Chinese Application No. CN201520372095.X, entitled "TAIL FIN ASSEMBLY FOR INFLATABLE PRODUCT," filed on Jun. 2, 2015, the disclosure of which is incorporated by reference herein in its entirety.

BACKGROUND INFORMATION

1. Technical Field

The present disclosure relates to a tail fin, in particular, to an easily assembled and disassembled tail fin assembly for an above water inflatable product, such as an inflatable boat, an inflatable surfboard or the like.

2. Background

A tail fin is an essential part of an above-water inflatable product such as an inflatable boat, a surfboard, an inflatable canoe, an inflatable rowboat or the like. The tail fin is typically mounted onto the bottom of an inflatable boat, a surfboard or the like, near its tail. In some instances, one tail fin is mounted to the bottom of the inflatable product. In other instances, two or more tail fins may be mounted to the bottom of the inflatable product in various configurations. The tail fin provides directionality and stability to the inflatable boat or the surfboard, making the turning more easily.

Tail fin assemblies typically include a fin and a pedestal, where the fin is secured on the pedestal and the pedestal is secured to the bottom of the inflatable product. The fin typically comprises a dorsal fin shape for reducing the resistance of water when sailing and may be constructed from a durable high strength material. The fin is designed to be a structure with thinner edge portions and thicker middle portions. Depending upon the application and use of the inflatable product, the fin may be constructed to different dimensions and shapes.

Certain prior art tail fin assemblies are constructed from PVC material where the fin and pedestal are integrally formed by injection molding and cannot be separated. Although these type of tail fins are fabricated by a simple process at low cost, these type of tail fins are prone to deform under high pressure, thereby affecting the directionality and stability of the inflatable products to which they are attached. Such prior art tail fins cannot be replaced after being cracked or damaged. Additionally, the package volume and weight of inflatable products with integrally-formed tail fins may be comparatively large, thereby increasing their packaging and shipping costs.

Other prior art tail fins include a dismountable tail fin assembly comprising a fin and a pedestal, where the pedestal is secured to the bottom of the inflatable product and the fin is fixedly secured to the pedestal. In these types, when the fin is broken off or damaged, or when a user wishes to use a tail fin with other shapes or dimensions, the fin must be dismounted from the pedestal and replaced. After use, the fin may be dismounted from the pedestal and stored. Typically, the fin is secured to the pedestal by metal bolts or other fasteners and special tools are needed to assemble and disassemble the fin from the pedestal. This may cause great inconvenience for the user. Furthermore, the metal bolts are vulnerable to corrosion and rust in water, especially in seawater.

Thus, a need therefore exists for a tail fin assembly having a detachable fin that is sturdy and durable yet simple to attach and remove from the inflatable product upon which the fin is mounted.

SUMMARY

One of the technical problems to be solved by the present disclosure is to provide a tail fin assembly for an inflatable product which is of a simple structure and easy to be mounted and dismounted.

Another technical problem to be solved by the present disclosure is to provide a tail fin assembly for an inflatable product in which the fin can be secured firmly to the pedestal and not prone to deflecting laterally.

Yet another technical problem to be solved by the present disclosure is to provide a tail fin assembly for an inflatable product which can be made in a convenient way at low cost.

To solve the aforementioned problems, the present disclosure provides a tail fin assembly for an inflatable product. In one example, the tail fin assembly includes a pedestal, a sliding groove, a fin, and a retainer. The pedestal is coupled to a surface of the inflatable product. The sliding groove is positioned on the pedestal. The sliding groove includes a pair of protruding locking members formed in one end of the sliding groove.

The fin includes a fin body and a fin base. The fin body is detachably coupled to the pedestal through the fin base, which slidably engages the sliding groove.

The retainer is coupled to the fin body to be positioned on the fin base. The retainer locks with the protruding locking members of the sliding groove to securing the fin to the pedestal.

In some implementations, the retainer includes an elastic U-shaped clip portion coupled between a pair of winged tabs. In some implementations, the retainer is configured to pass through an opening formed through a bottom surface of the fin base to project out from an upper surface of the fin base.

In some implementations, the clip portion is configured to be received by and retained within a seat formed in a lower portion of the fin body. In some implementations, the pedestal includes an enclosure, a pedestal boss, and a pedestal base. The enclosure includes a top surface, a hollowed interior, an open end, and a closed end. The enclosure is fixed atop the pedestal boss, where the enclosure and the pedestal boss define the sliding groove therebetween.

In some implementations, the fin base includes a base plate and a boss portion raised from the base plate. The fin body is coupled to the raised boss portion.

In some implementations, a sliding slot is formed in the top surface of the enclosure. The sliding slot is adapted to pass the raised boss portion therethrough.

In some implementations, the locking members are formed on the top surface of the enclosure proximal the open end of the enclosure, where the fin base is inserted at the open end into the sliding groove, and where free ends of the winged tabs of the retainer abut against the locking members of the enclosure to fasten the fin to the pedestal.

In some implementations, the locking members include a pair of opposing teeth that extend into sliding slot, where each tooth includes an angled bearing surface and a transverse locking surface. The bearing surface is engaged by the raised boss portion when the fin base is inserted into the sliding groove.

In some implementations, the opening formed in the bottom surface of the fin base is constructed to a substantially U-shaped profile that substantially corresponds in shape and dimensions with the retainer.

In some implementations, a clip seat is formed in a lower portion of the fin body. In some implementations, the retainer is made of polyoxymethylene.

In some implementations, the base plate is configured to engage the sliding groove and the raised boss portion is configured to engage the sliding slot when the fin base is slidably coupled to the pedestal. In some implementations, the pedestal is fixed to the surface of the inflatable product by bonding or welding.

Tail fin assemblies of the present disclosure have several advantages over the prior art. First, the tail fin assembly has a simple structure where the fin can be easily assembled and disassembled from the inflatable product. Since the retainer can be pre-assembled, it only requires an insert operation to mount the fin onto the pedestal. Also, only a simple pinch of the two winged tabs of the retainer is needed disengage the retainer from the sliding slot to dismount the fin from the pedestal.

Second, the fin of the tail fin assembly can be secured on the pedestal firmly, such that the fin is less likely to deform or breaking off. Third, the tail fin assembly can be simply made at low cost.

Other devices, apparatus, systems, methods, features and advantages of the disclosure will be or will become apparent to one with skill in the art upon examination of the following figures and detailed description. It is intended that all such additional systems, methods, features and advantages be included within this description, and be protected by the accompanying claims.

BRIEF DESCRIPTION OF THE DRAWINGS

The above-mentioned and other features, properties and advantages of the present disclosure will become more apparent from the following description of embodiments with reference to the accompanying drawings, in which.

DETAILED DESCRIPTION

The present disclosure will be further described below in conjunction with detailed embodiments and the accompanying drawings. More details are provided in the following detailed description in order for the present disclosure to be fully understood. However, the present disclosure can be implemented in various ways other than those described herein. A person skilled in the art can make similar analogy and modification according to the practical applications without departing from the spirit of the present disclosure, and therefore the contents of the detailed embodiments herein should not be construed as limiting to the scope of the present disclosure.

Figure 1:
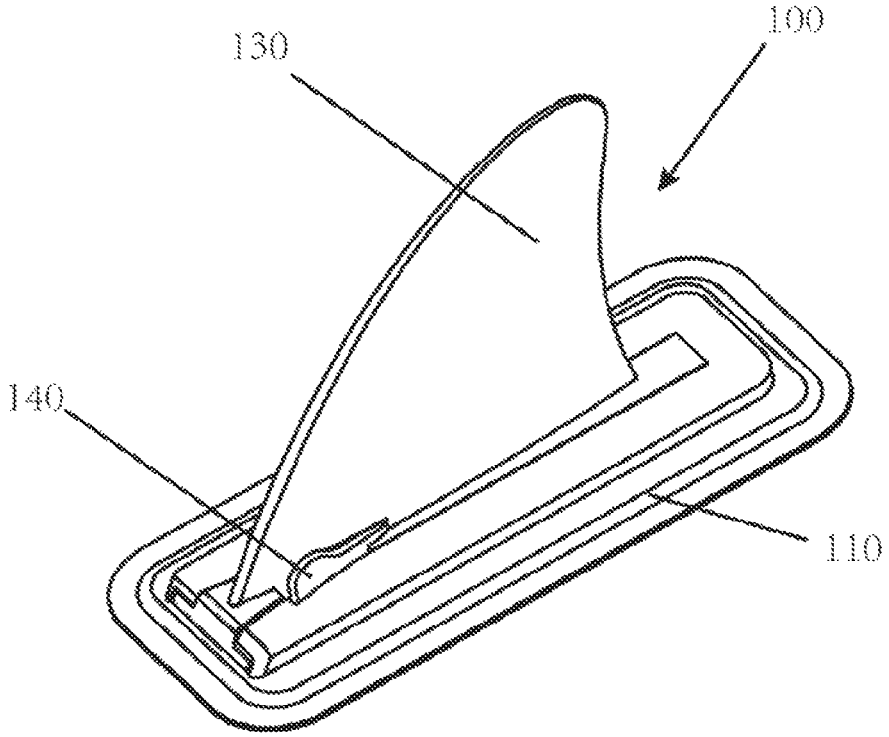
FIG. 1 is a perspective view illustrating one example of an implementation of a tail fin assembly for an inflatable product according to the teachings of the present disclosure.
Figure 2:
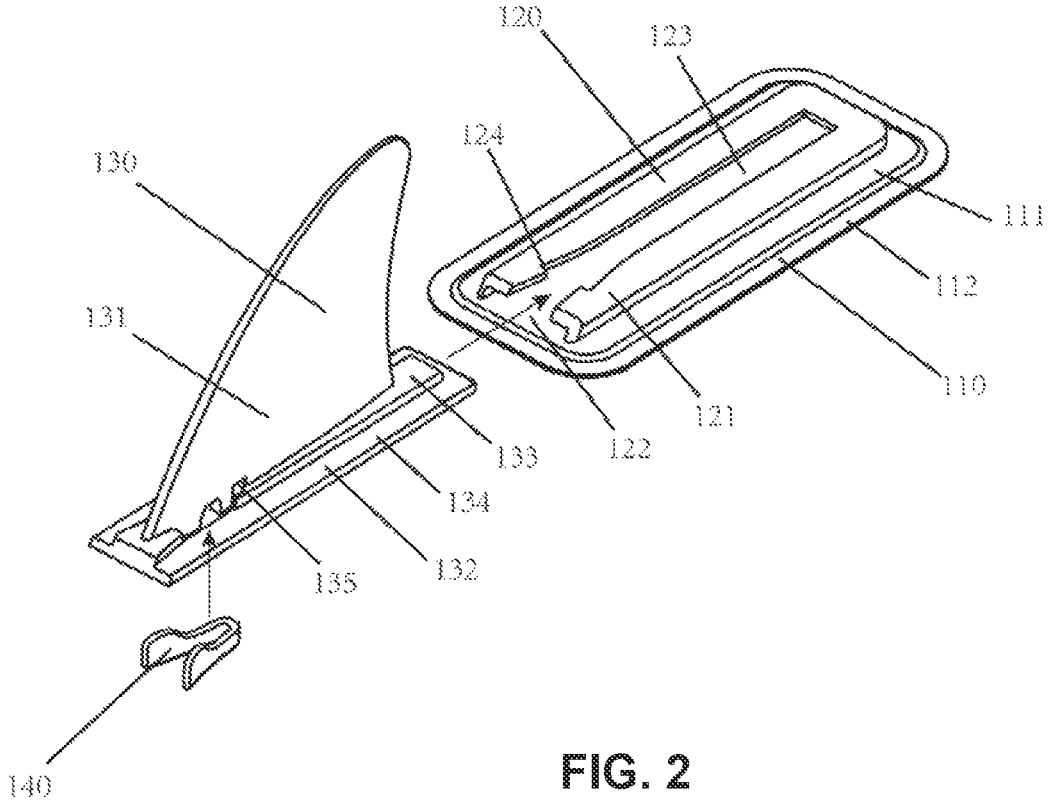
FIG. 2 is an exploded perspective view of the tail fin assembly of FIG. 1 illustrating how the fin is assembled with the pedestal.

FIGS. 1-8 illustrate one example of an implementation of a tail fin assembly 100 for an above-water inflatable product according to teachings of the present disclosure. In particular, as shown in FIGS. 1 and 2, the tail fin assembly 100 generally includes a pedestal 110, a sliding groove 120, a fin 130, and a retainer 140. The pedestal 110 is coupled to a surface of the inflatable product. The pedestal 110 may be secured to the surface of the inflatable product by bonding, high-frequency welding, fasteners, or other suitable means.

The sliding groove 120 is positioned on the pedestal 110. The sliding groove 120 includes a pair of protruding locking members 124 formed at one end of the sliding groove 120.

The fin 130 includes a fin body 131 and a fin base 132. The fin body 131 is detachably coupled to the pedestal 110 via the fin base 132, which slidably engages the sliding groove 120.

The retainer 140 may be coupled to the fin body 131 and positioned within a notch or seat portion 135 formed in a lower portion of the fin body 131, just above the fin base 132. The retainer 140 is configured to lockingly engage the protruding locking members 124 formed in the sliding groove 120 to secure the fin 130 to the pedestal 110.

Additionally, the fin base 132 includes a base plate 134 and a raised boss portion 133. The fin body 131 is coupled to the raised boss portion 133. The base plate 134 is configured to engage the sliding groove 120 and the raised boss portion 133 is configured to engage the sliding slot 123 when the fin base 132 is slidably engaged with or coupled to the pedestal 110.

Figure 3:
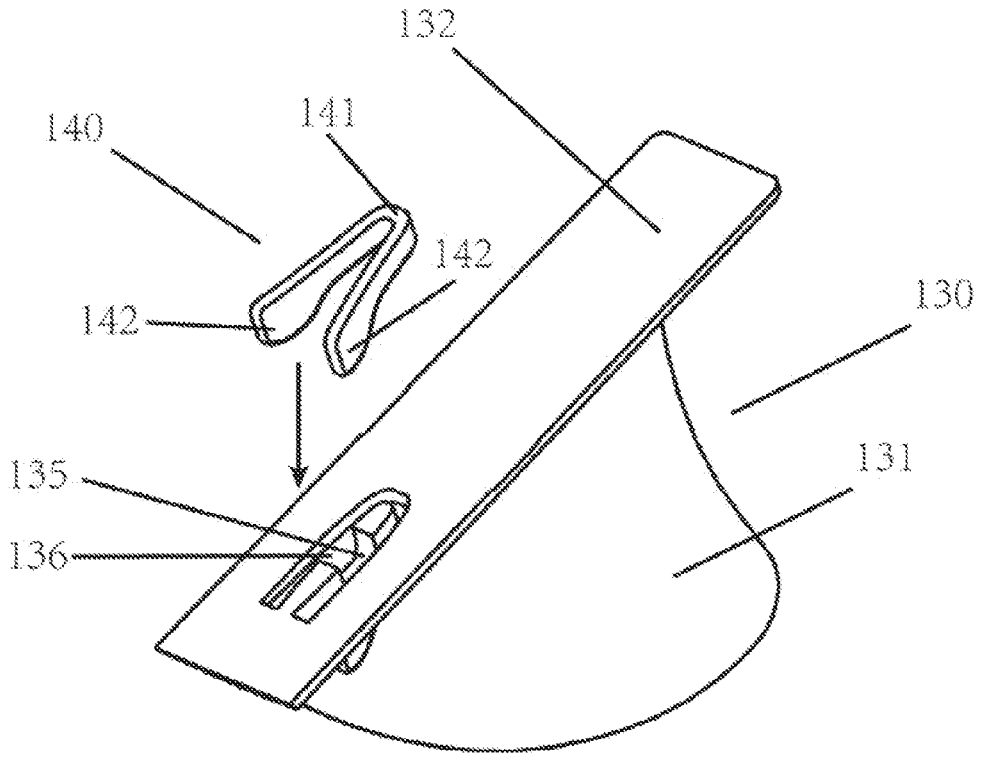
FIG. 3 is a bottom perspective view of the tail fin assembly of FIG. 1 illustrating how the retainer is assembled within the pedestal.
Figure 4:
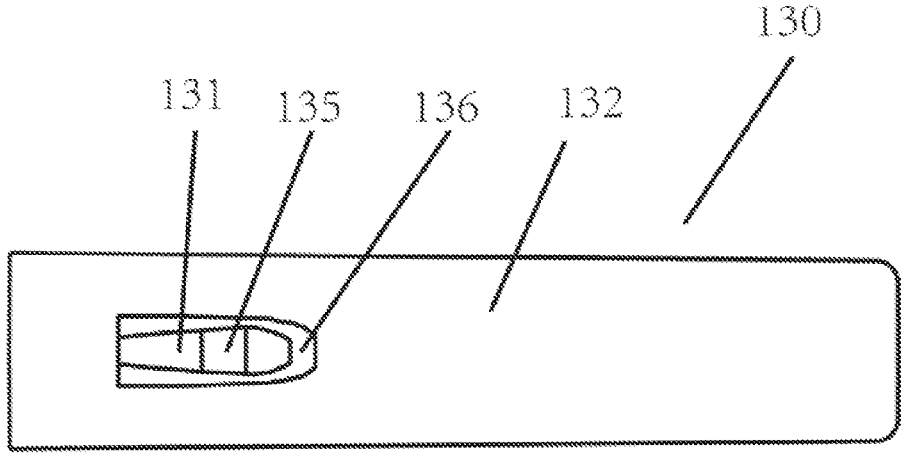
FIG. 4 is a bottom view of the tail fin assembly of FIG. 1.

FIG. 3 is a bottom perspective view of the tail fin assembly 100, showing how the retainer 140 is assembled within the pedestal 110. FIG. 4 is a bottom view of the tail fin assembly 100.

As shown in FIGS. 3 and 4, and in conjunction with FIGS. 1 and 2, the retainer 140 may be made of polyoxymethylene (POM) or other materials with suitable rigidity and elasticity. The retainer 140 includes an elastic U-shaped clip portion 141 coupled between a pair of winged tabs 142. The retainer 140 is configured to pass through an opening 136 formed through a bottom surface of the fin base 132 and project out an upper surface of the fin base 132. The opening 136 formed in the bottom surface of the fin base 132 is constructed to a substantially U-shaped profile that substantially corresponds in shape and dimensions with the retainer 140. The clip portion 141 is configured to be received by and retained within a seat 135 formed in a lower portion of the fin body 131.

Figure 5:
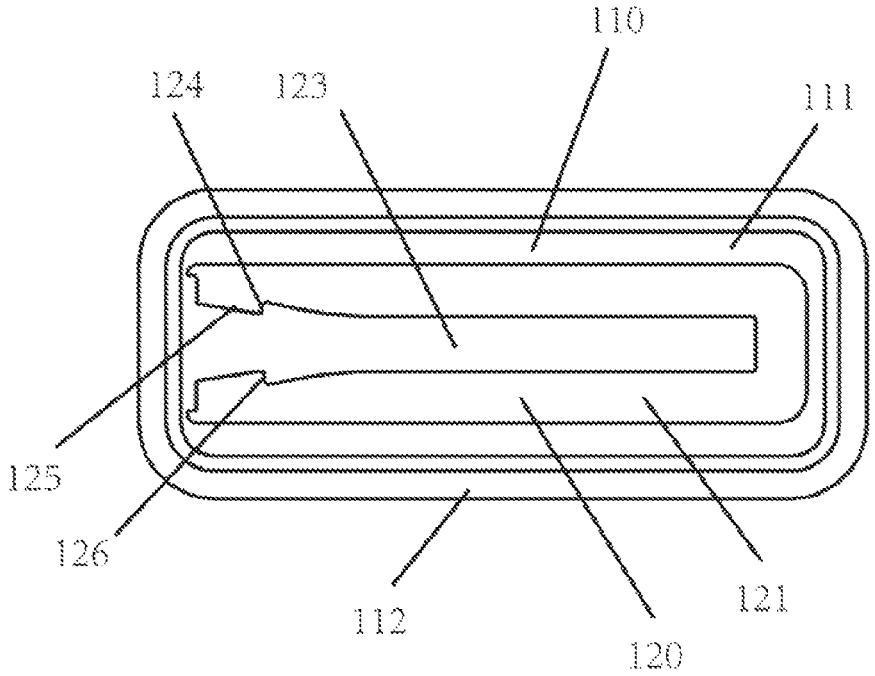
FIG. 5 is a top plan view of the pedestal of the tail fin assembly of FIG. 1.

FIG. 5 is a top plan view illustrating various features of the pedestal 110 of the tail fin assembly 100. As shown in FIG. 5, and in conjunction with FIGS. 1 and 2, the pedestal 110 includes an enclosure 121, a pedestal boss 111, and a pedestal base 112. The enclosure 121 includes a top surface, a hollowed interior, an open end 122 and a closed end. As shown in FIG. 2, the enclosure 121 is fixed atop the pedestal boss 111, where the enclosure 121 and the pedestal boss 111 define the sliding groove 120 therebetween. A sliding slot 123 is formed in the top surface of the enclosure 121. The sliding slot 123 is adapted to pass the raised boss portion 133 therethrough.

Turning back to FIG. 5, the pedestal 110 further includes a pair of protruding locking member 124, which are formed in the sliding slot 123 proximal the open end 122 of the enclosure 121. As shown in conjunction with FIG. 2, the fin base 132 may be inserted from the open end 122 into the sliding groove 120 such that the free ends of the winged tabs 142 of the retainer 140 are abutted against the locking members 124 of the enclosure 121 to detachably fasten the fin 130 to the pedestal 110.

In the example shown, the locking members 124 include a pair of opposing teeth that extend into sliding slot 123, each tooth having an angled bearing surface 125 and a transverse locking surface 126. The bearing surface 125 corresponds to the fin base 132 when the fin base 132 is inserted into the sliding groove 120.

Figure 6:
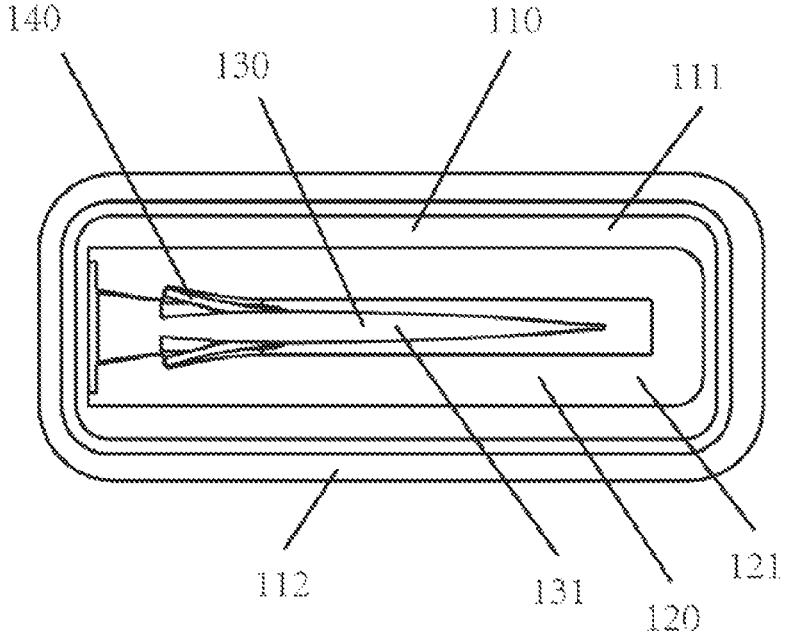
FIG. 6 is a top view of the tail fin assembly of FIG. 1 showing the fin assembled with the pedestal.
Figure 7:
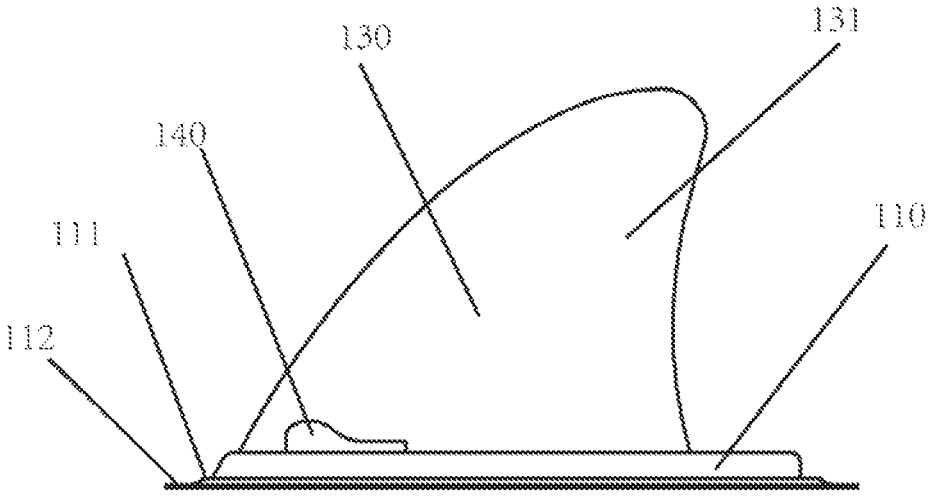
FIG. 7 is a side view of the tail fin assembly of FIG. 1.
Figure 8:
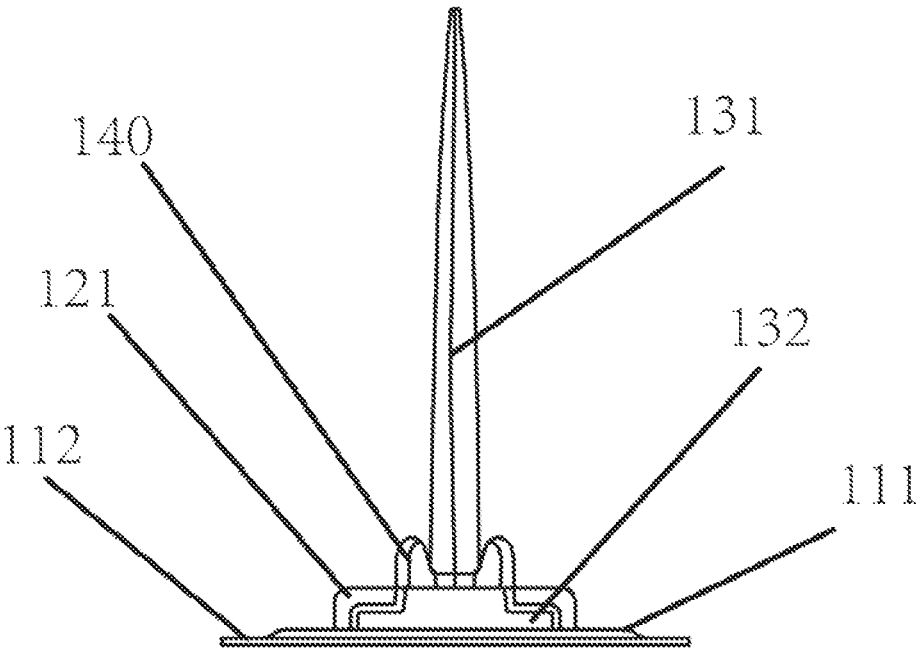
FIG. 8 is a front view of the tail fin assembly of FIG. 1.

FIGS. 6, 7 and 8 are respectively a top plan view, a side view and a front view of the assembled structure of the retainer and the fin of the tail fin assembly for an inflatable product according to the present disclosure.

FIG. 6 is a top view of the tail fin assembly 100 showing the fin 130 assembled with the pedestal 110. FIG. 7 is a side view and FIG. 8 is a front view of the tail fin assembly 100.

According to the present disclosure, the pedestal 110, the fin 130, and the retainer 140 of the tail fin assembly 100 may be assembled and disassembled by the following steps. First, the fin 130 may be assembled with the pedestal 110 by squeezing or biasing the two winged tabs 142 of the retainer 140 together by hand, and pass the retainer 140 through the opening 136 on the bottom of the fin base 132 until the retainer 140 protrudes upwards from the upper surface of the raised boss portion 133 and snaps into the seat 135 on the lower portion of the fin body 131, as shown in FIG. 7. Once the retainer 140 is snapped into place with the seat 135, the force applied to the two winged tabs 142 of the retainer 140 may be release to permit the tabs 142 to spring or recoil back to their original, unbiased positions.

Next, the fin base 132 may be inserted from the open end 122 into the sliding groove 120, as shown in FIG. 2, until the top ends of the two winged tabs 142 of the retainer 140 are in abutment against the two locking members 124 of the enclosure 121, thereby finishing the assembly and securing the fin 130 to the pedestal 110.

In the alternative, to disassemble the fin 130 from the pedestal 110, the two winged tabs 142 of the retainer 140 may be squeezed or biased together by hand, thus allowing the fin base 132 to slide out of the sliding groove 120. It should be noted that for daily usage, in order to save assembly time, the retainer 140 may preferably be pre-assembled with the fin 130.

According to the present disclosure, several methods may be used to couple the tail fin assembly 100 to the bottom of an inflatable product, such as a surfboard, boat or the like. For example, one method is bonding by an adhesive. Under this method, the tail fin assembly 100 may be mounted onto the underside of an inflatable product by bonding the bottom of its pedestal 110 to the bottom surface of the inflatable product with glue or other adhesive.

Another coupling method is by high-frequency welding. Under this method, the tail fin assembly 100 may be mounted onto the inflatable product by high-frequency welding the pedestal base 112 of the pedestal 110 to the underside of the inflatable product.

Tail fin assemblies of the present disclosure have several advantages over the prior art.

First, the tail fin assembly has a simple structure where the fin can be easily assembled and disassembled from the inflatable product. Since the retainer can be pre-assembled, it only requires an insert operation to mount the fin onto the pedestal. Also, only a simple pinch or squeeze of the two winged tabs of the retainer is needed to disengage the retainer from the sliding slot to dismount the fin from the pedestal.

Second, the fin of the tail fin assembly may be secured on the pedestal firmly, such that the fin is less likely to deform or breaking off. Third, the tail fin assembly can be made in a convenient, low cost manner.

While particular implementations of the present disclosure have been described herein as being used with inflatable products, persons skilled in the art will appreciate that tail fin assemblies of the present disclosure may be used in connection with any type of floatation device, such as wooden or fiberglass surfboard, boats, rafts, kayaks, canoes, sailboards, paddleboard, and the like. In addition, while particular implementations of the present disclosure have been described herein as having a fin formed in a dorsal fin shape, persons skilled in the art will also appreciate that fins of the present disclosure may be constructed in various shapes and sizes, depending on the intended use of the flotation device. Further, while particular implementations of the present disclosure have been described herein as having a retainer in the form of a clip, persons skilled in the art will also appreciate that retainers of the present disclosure may include other quick latching devices.

In general, terms such as "coupled to," and "configured for coupling to," and "secured to," and "configured for securing to" and "in communication with" (for example, a first component is "coupled to" or "is configured for coupling to" or is "configured for securing to" or is "in communication with" a second component) are used herein to indicate a structural, functional, mechanical, electrical, signal, optical, magnetic, electromagnetic, ionic or fluidic relationship between two or more components or elements. As such, the fact that one component is said to be in communication with a second component is not intended to exclude the possibility that additional components may be present between, and/or operatively associated or engaged with, the first and second components.

The present disclosure has been described above in connection with the example implementations which, however, are not intended to be limiting to the scope of the present disclosure, and any person skilled in the art could make possible changes and modifications without departing from the spirit and scope of the present disclosure. Thus, any amendments, equivalent changes, modifications to the above-mentioned embodiment based on the technical essence of the present disclosure, shall fall within the scope defined by the appended claims of the present disclosure.

LIST OF REFERENCE NUMBERS

100 tail fin assembly
110 pedestal
111 pedestal boss
112 pedestal base
120 sliding groove
121 enclosure
122 open end
123 sliding slot
124 locking member
125 bearing surface
126 locking surface
130 fin
131 fin body
132 fin base
133 raised boss
134 base plate

135 seat
136 opening
140 retainer
141 clip portion
142 winged tab

What is claimed is:

1. A tail fin assembly for an inflatable product, the assembly comprising:

a pedestal coupled to a surface of the inflatable product;

a sliding groove positioned on the pedestal, the sliding groove comprising a pair of protruding locking members formed at one end of the sliding groove;

a fin comprising a fin body upwardly extending from a fin base, the fin body being detachably coupled to the pedestal at the fin base which slidably engages the sliding groove; and a retainer coupled to the fin and positioned between the fin body and the fin base, the retainer being adapted to lockingly engage the protruding locking members to secure the fin to the pedestal, the retainer comprising an elastic U-shaped clip portion coupled between a pair of winged tabs.

2. The tail fin assembly of claim 1, wherein the retainer is configured to pass through an opening formed through a bottom surface of the fin base to project out from an upper surface of the fin base.

3. The tail fin assembly of claim 1, wherein the clip portion is configured to be received by and retained within a seat formed in a lower portion of the fin body.

4. The tail fin assembly of claim 1, wherein the pedestal comprises a pedestal boss raised from a pedestal base and an enclosure having a top surface, a hollowed interior, an open end, and a closed end, and wherein the enclosure is fixed atop the pedestal boss and the enclosure and the pedestal boss define the sliding groove therebetween.

5. The tail fin assembly of claim 4, wherein the fin base comprises a base plate and a raised boss portion positioned on the base plate, where the fin body is coupled to the raised boss portion.

6. The tail fin assembly of claim 4, wherein the enclosure comprises a sliding slot formed in the top surface of the enclosure, the sliding slot being adapted to receive and pass the raised boss portion therethrough.

7. The tail fin assembly of claim 6, wherein the locking members are formed in the top surface of the enclosure proximal the open end of the enclosure, and wherein the fin base is inserted from the open end into the sliding groove, and wherein free ends of winged tabs of the retainer abut against the locking members of the enclosure to fasten the fin to the pedestal.

8. The tail fin assembly of claim 7, wherein the locking members comprise an opposing pair of teeth that extend into the sliding slot, each tooth having an angled bearing surface and a transverse locking surface, the bearing surface being engaged by the raised boss portion when the fin base is inserted into the sliding groove.

9. The tail fin assembly of claim 2, wherein the opening formed in the bottom surface of the fin base is constructed to a substantially U-shaped profile that substantially corresponds in shape and dimensions with the retainer.

10. The tail fin assembly of claim 3, wherein the clip seat is formed in a lower portion of the fin body.

11. The tail fin assembly of claim 1, wherein the retainer is made of polyoxymethylene.

12. The tail fin assembly of claim 6, wherein the base plate is configured to engage the sliding groove and the raised boss portion is configured to engage the sliding slot when the fin base is slidably coupled to the pedestal.

13. The tail fin assembly of claim 1, wherein the pedestal is fixed to the surface of the inflatable product by bonding or welding.

* * * * *